US007130438B2

(12) United States Patent
Lin

(10) Patent No.: US 7,130,438 B2
(45) Date of Patent: Oct. 31, 2006

(54) ACOUSTIC ENCLOSURE FOR SINGLE AUDIO TRANSDUCER

(76) Inventor: Fong-Jei Lin, 19450 Via Madronas Ct., Saratoga, CA (US) 95070

( * ) Notice: Subject to any disclaimer, the term of this patent is extended or adjusted under 35 U.S.C. 154(b) by 520 days.

(21) Appl. No.: 10/744,315

(22) Filed: Dec. 22, 2003

(65) Prior Publication Data

US 2005/0135647 A1 Jun. 23, 2005

(51) Int. Cl.
*H04R 1/20* (2006.01)

(52) U.S. Cl. ..... 381/337; 181/184

(58) Field of Classification Search ..... 381/161, 381/337–340, 345, 351, 352, 391; 181/143, 181/152, 153, 155, 156, 182–190, 196–199
See application file for complete search history.

(56) References Cited

U.S. PATENT DOCUMENTS

| | | | | |
|---|---|---|---|---|
| 1,481,634 | A * | 1/1924 | Thomas | 181/186 |
| 6,604,602 | B1 * | 8/2003 | Kim | 381/351 |
| 6,950,530 | B1 * | 9/2005 | Baird et al. | 381/340 |

* cited by examiner

*Primary Examiner*—Daniel Swerdlow

(57) ABSTRACT

An acoustic enclosure for a single sound transducer has sound pressure apertures near the end where the transducer is located, and sound apertures in a wall at the other end. The sound apertures enable the low, mid-range, and high frequency sounds to exit the enclosure along different paths. The sound aperture end can be flat or contoured with one or two outwardly extending members having straight or tapered end walls in which the mid-range and high frequency sound apertures are formed. One or two inwardly extending members can also be provided in the interior of the enclosure. The sound pressure apertures can be fixed or adjustable.

20 Claims, 10 Drawing Sheets

ACOUSTIC ENCLOSURE FOR SINGLE AUDIO TRANSDUCER

BACKGROUND OF THE INVENTION

This invention relates generally to enclosures for audio transducers, such as speaker enclosures for home audio systems, vehicle sound systems, personal headsets, hearing aids and the like. More particularly, this invention relates to an acoustic enclosure for an audio transducer which enables a single transducer to generate audio over a wide spectral range essentially identical to that afforded by systems which use multiple audio transducers to cover the same range of the audio spectrum.

The acoustics art is highly developed and many versions of acoustic systems are currently available in the market. One standard type of acoustic system uses a combination (usually three) of audio transducers mounted within a single housing enclosure. A first transducer type (usually termed a tweeter) generates audio in the high frequency range; a second transducer type (usually termed a woofer) generates audio in the low frequency range; and a third transducer type (usually termed a mid-range) generates audio in the mid-frequency range. Many different configurations of this standard type have been proposed and implemented: some using passive electrical networks and others using mechanical baffles to shape and enhance the quality of the sound produced by the transducers. These standard type systems generally require relatively large amounts of electrical power to operate the transducers and also require a relatively large amount of space (referred to in the trade as having a large footprint).

More recently, a different type of acoustic system has been introduced which combines smaller transducers in separate enclosures with electronic signal processing techniques to provide enhanced audio effects with lower electrical power consumption and a smaller footprint. Examples of this type of system abound in current advertisements for home theater systems. Such systems still require separate transducers, each dedicated to a particular portion of the audio spectrum (such as woofers, tweeters, and mid-range transducers).

SUMMARY OF THE INVENTION

The invention comprises an acoustic enclosure which can be combined with a single audio transducer, such as a speaker, to provide high quality sound covering the entire audio spectrum.

In a broadest aspect, the invention comprises an acoustic enclosure for a single audio transducer, the enclosure comprising a housing having a first end adapted to be acoustically coupled to an audio transducer, a second end, and a surface extending between the first and second ends. The first and second ends and the surface together define an acoustic enclosure having an interior. The surface is provided with a plurality of sound pressure apertures formed therethrough in a region adjacent the first end to which the audio transducer is acoustically coupled. These sound pressure apertures may be fixed in size or adjustable in size to aid in setting up the enclosure. The second end has a plurality of sound apertures formed therethrough for allowing sounds produced by an associated sound transducer and traveling along the interior to emanate from the interior to ambient. The plurality of sound apertures includes a first low frequency group for allowing low frequency sounds to emanate from the interior, a second mid-range frequency group for allowing mid-range frequency sounds to emanate from the interior, and a centrally positioned high frequency sound aperture for allowing high frequency sounds to emanate from the interior.

The housing surface is preferably cylindrical, and the sound pressure apertures are distributed about the periphery of the cylindrical surface. The second end is preferably circular, the first low frequency group of sound apertures is distributed about the second end in a substantially circular pattern of first radius, and the second mid-range frequency group of sound apertures is distributed about the second end in a substantially circular pattern of second radius smaller than the first radius.

The first end optionally includes a detachment coupling element for enabling the housing to be removable attached to an associated audio transducer housing.

In several embodiments, the second end includes an outwardly extending portion terminating in an end wall portion; and the high frequency sound aperture is formed in the end wall portion.

In some embodiments, a first interior sound enclosure portion extends inwardly from the second end of the housing into the interior thereof to define a mid-range frequency enclosure area. In these embodiments, the mid-range frequency sound apertures are located within this mid-range frequency enclosure area.

In some embodiments, the second end includes a first outwardly extending portion terminating in a first end wall portion and the mid-range frequency sound apertures are formed in this first end wall portion. The first outwardly extending portion may optionally be a discrete element having an inner end with a first detachable coupling element. In this embodiment, the second end of the housing is provided with a complementary coupling element so that the discrete element can be detachably coupled to the second end of the housing. The first end wall portion can also include a second outwardly extending portion terminating in a second end wall portion. In this embodiment, the high frequency sound aperture is formed in the second end wall portion. The first and second outwardly extending portions are preferably cylindrical with the diameter of the second outwardly extending portion being smaller than the diameter of the first outwardly extending portion. The first end wall portion may be flat or tapered. Similarly, the second end wall portion may be flat or tapered.

A protective shield member may be provided which extends outwardly of the second end of the housing and surrounds the first and second outwardly extending portions. This protective shield may be a discrete member, or formed as an integral part of the enclosure housing.

For those embodiments having one or two portions extending outwardly from the second end of the enclosure housing, a first interior sound enclosure portion may be included which extends inwardly from the second end of the housing into the interior thereof to define a mid-range frequency enclosure area, with the mid-range frequency sound apertures being located within this mid-range frequency enclosure area. In addition, a second interior sound enclosure portion may be included which also extends inwardly from the second end of the housing into the interior thereof to define a high frequency enclosure area, the high frequency sound aperture being located within the high frequency enclosure area.

For those embodiments in which the second end of the enclosure is a flat face having the mid-range and high frequency sound apertures formed therein, a first interior sound enclosure portion may be included which extends inwardly from the second end of the housing into the interior thereof to define a mid-range frequency enclosure area, the mid-range frequency sound apertures being located within this mid-range frequency enclosure area. A second interior sound enclosure portion may be included which also extends inwardly from the second end of the housing into the interior thereof to define a high frequency enclosure area, with the high frequency sound aperture being located within this high frequency enclosure area.

In all embodiments, the high frequency enclosure area is preferably smaller than the mid-range frequency enclosure area.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
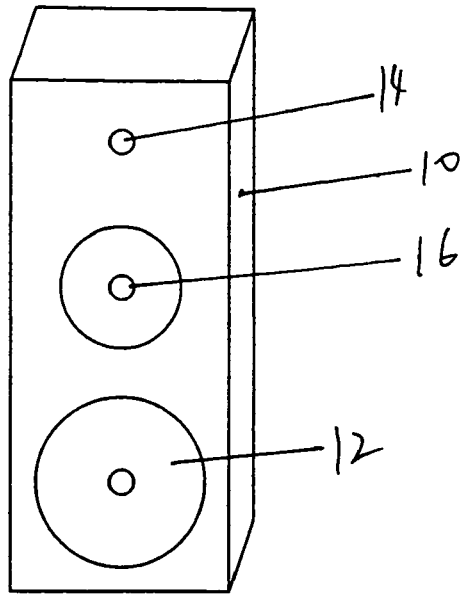
PRIOR ART FIG. 1
FIG. 1 is a schematic view of a standard three transducer home audio system.

Turning now to the drawings, FIG. 1 is a schematic view of a standard three transducer home audio system. As seen in this Fig., a single cabinet housing 10 provides a mounting enclosure for three transducers: a woofer 12 for reproducing sounds in the low frequency audio range; a tweeter 14 for reproducing sounds in the high frequency audio range; and a mid-range 16 for reproducing sounds in the mid-frequency audio range. Typically, two such enclosures 10 and transducers 12, 14, and 16 are provided so that a two channel stereo effect can be produced.

Figure 2:
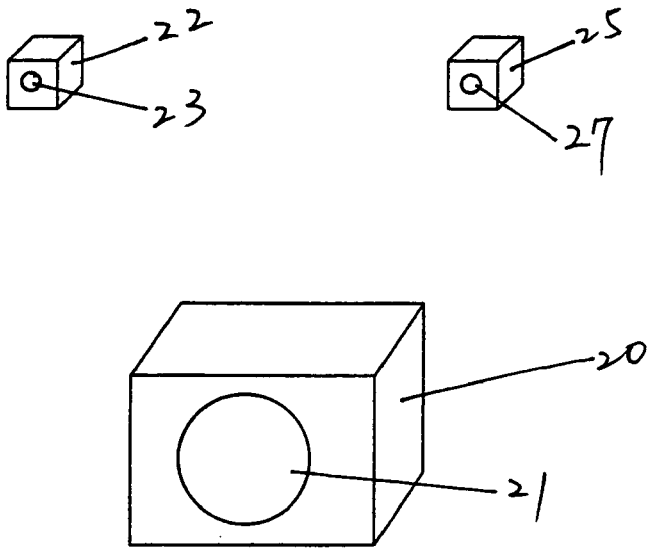
PRIOR ART FIG. 2
FIG. 2 is a schematic view of a conventional home theater system using individual enclosures for transducers.

FIG. 2 illustrates a more current home theater system. As seen in this Fig., a first housing enclosure 20 contains a woofer transducer 21 for reproducing sounds in the low frequency audio range. A second housing enclosure 22 contains a first tweeter transducer 23 for reproducing sounds in the high frequency audio range. A third housing enclosure 25 contains a second tweeter transducer 27 also for reproducing sounds in the high frequency audio range. The relative strengths of the low frequency and high frequency sounds are electronically controlled by circuitry (not shown) to emulate the full audio frequency spectrum and to provide stereo, surround sound and other acoustic effects. The sizes of the individual enclosures 20, 22, and 25 in the home theater system of FIG. 2 is substantially smaller than the standard system shown in FIG. 1, as is the electrical power consumption. However, both types of systems require several transducers in order to produce the desired full audio range effect.

Figure 3:
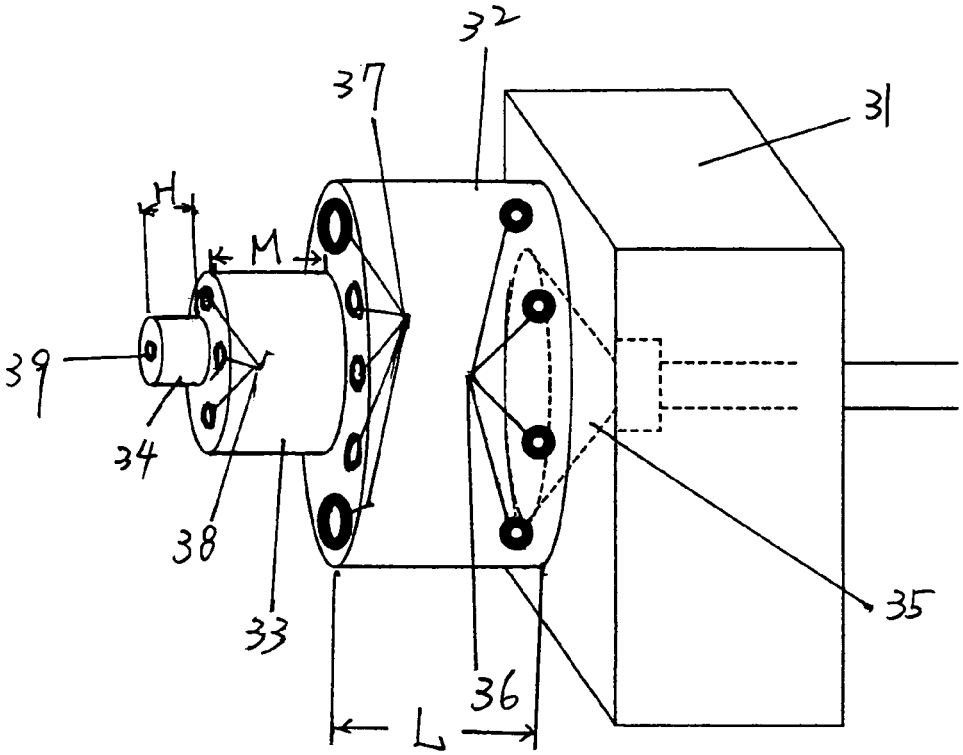
FIG. 3 is a schematic view in perspective of a first embodiment of the invention.
Figure 4:
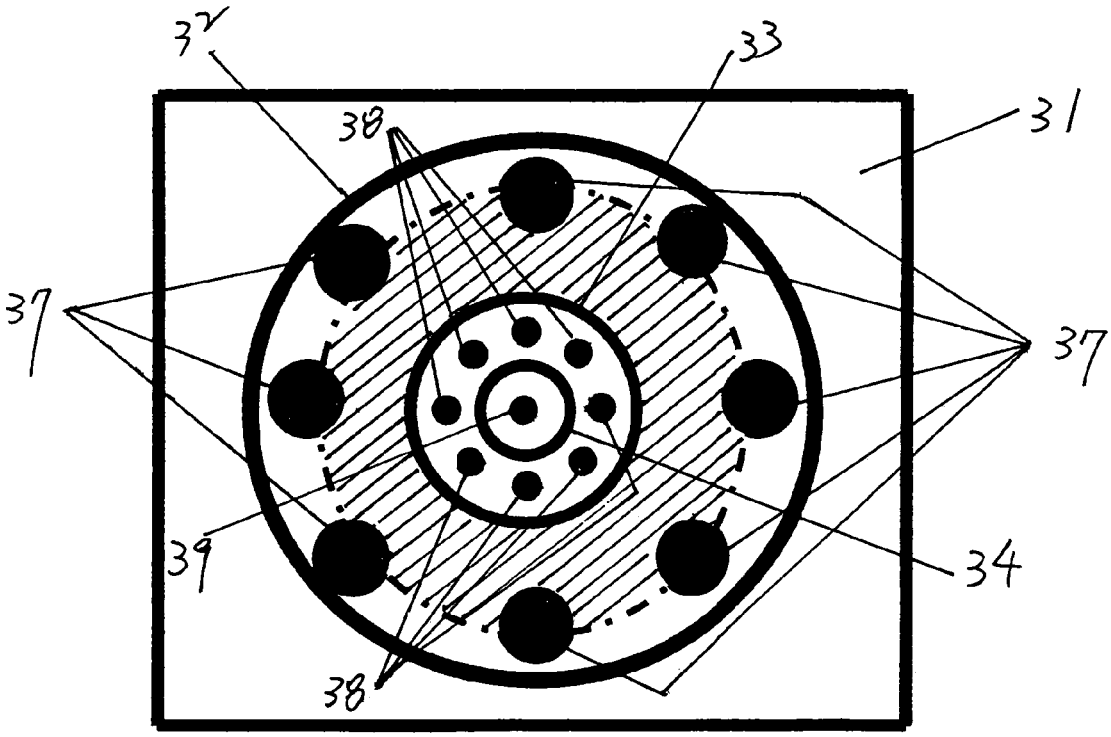
FIG. 4 is a front plan view of the FIG. 3 embodiment showing the placement of the sound apertures.

FIGS. 3 and 4 illustrate a first embodiment of the invention, which requires only a single transducer to achieve the same audio effects as those provided by the two prior art systems described above. As seen in FIG. 3, an acoustic housing generally designated with reference numeral 30 comprises four separate portions 31–34. Mounted within portion 31 is a single speaker/transducer 35 capable of reproducing sounds over the audio frequency spectrum of interest. Portion 32 provides a first acoustic chamber for acoustically processing the low frequency sound produced by speaker/transducer 35. Portion 32 includes air pressure balancing apertures 36, and low frequency sound emanating apertures 37 which allow low frequency sound pressure waves to exit enclosure portion 32 (see FIGS. 3 and 4). Portion 33 includes mid-range frequency sound emanating apertures 38 which allow sound pressure waves in the mid-frequency acoustic range to exit enclosure portion 33. Portion 34 includes a high frequency sound emanating aperture 39 which allows high frequency sound pressure waves to exit enclosure portion 34. Preferably, the geometry used is right circular cylindrical, so that portions 32, 33, and 34 are each right circular cylinders of diminishing diameters, and the sound emanating apertures 37 and 38 are distributed about the axis of symmetry and sound emanating aperture 39 is located on this axis.

The total area subtended by low frequency apertures 37 is termed the total low frequency aperture area; the total area subtended by the mid-range frequency apertures 38 is termed the total mid-range frequency aperture area; and the total area subtended by the high frequency aperture 39 is termed the total high frequency aperture area. The total area of each of the frequency-specific apertures is obtained by summing the areas of each of the individual apertures in a frequency-specific class. Thus, for example, the total low frequency aperture area is obtained by summing the areas of all apertures 37; the total mid-range frequency aperture area is obtained by summing the areas of all apertures 38; and the total high frequency aperture area is simply the area of aperture 39. The area subtended by the outer face of low frequency housing portion 32 is termed the low frequency enclosure area; the area subtended by the outer face of mid-range frequency housing portion 33 is termed the mid-range frequency enclosure area; and the area subtended by the outer face of high frequency housing portion 34 is termed the high frequency enclosure area. The actual dimensions of the apertures 37–39 will vary with the size of the enclosure itself. In order to obtain the benefits of the invention, the following dimensional constraints should be observed. The low frequency enclosure area>the speaker/transducer 35 core area>the mid-range frequency enclosure area>the high frequency enclosure area. Also, the total low frequency aperture area>the total mid-range frequency aperture area>the total high frequency aperture area. In addition, the length L along the axis of the low frequency housing portion 32>the length M along the axis of the mid-range frequency housing portion 33>the length H along the axis of the high frequency housing portion 34.

Figure 5:
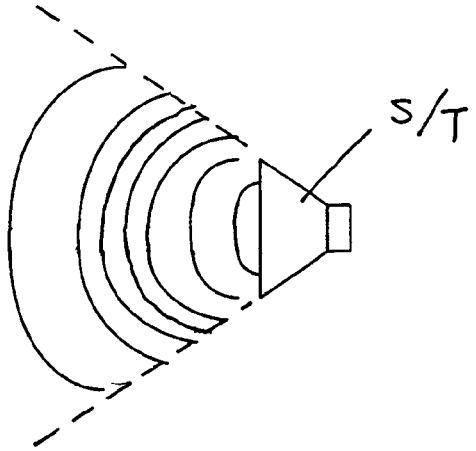
FIG. 5 is a wave diagram showing the acoustic wave distribution of a conventional speaker.
Figure 6:
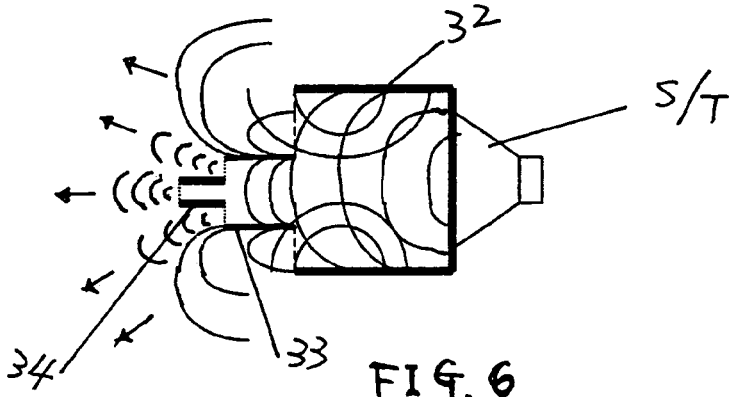
FIG. 6 is a wave diagram showing the acoustic wave distribution provided by the invention.
Figure 7:
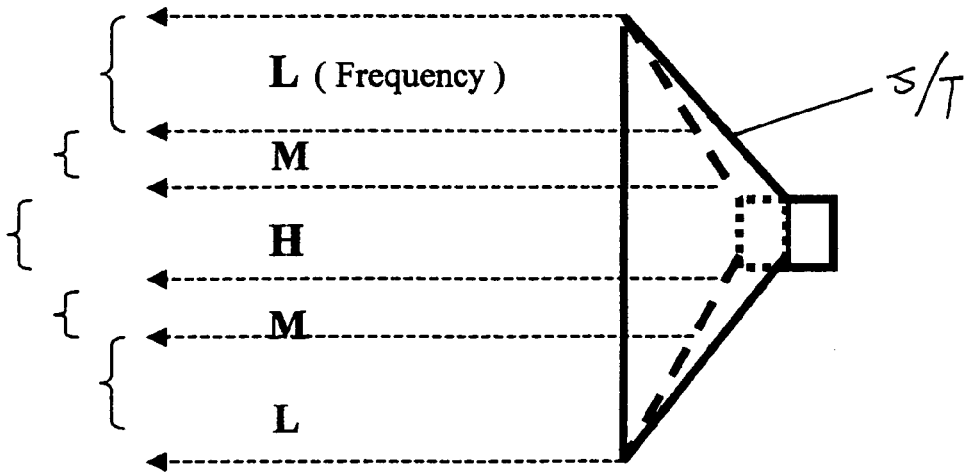
FIG. 7 is a schematic diagram illustrating the acoustic wave frequency distribution across a speaker core.

FIGS. 5 and 6 schematically illustrate the differences in acoustic wave distribution for conventional acoustic enclosures of the type illustrated in FIGS. 1 and 2, and the invention shown in FIGS. 3 and 4. With reference to the conventional acoustic wave distribution of FIG. 5, the sound waves generated by the speaker/transducer S/T emanate as partially spherical waves along a path whose spherical geometry is initially defined by the solid angle subtended by the core of S/T. In contrast, the wave distribution afforded by the invention is a complex pattern consisting of low frequency waves shaped and reinforced by low frequency housing portion 32 and emanating outwardly therefrom, mid-frequency range waves distributed outwardly of mid-frequency housing portion, and high frequency waves distributed outwardly of high frequency housing portion 34, with the low, mid-range, and high frequency waves being mutually separated. With reference to FIG. 7, this separation is due in part to the fact that the acoustic frequencies are generally distributed across the cone of S/T in the manner shown, with the low frequency wave portions being concentrated near the outer portion of the cone, the high frequency wave portions being concentrated near the center of the cone, and the mid-range frequency wave portions being concentrated intermediate the high and low frequency wave portions.

Figure 8:
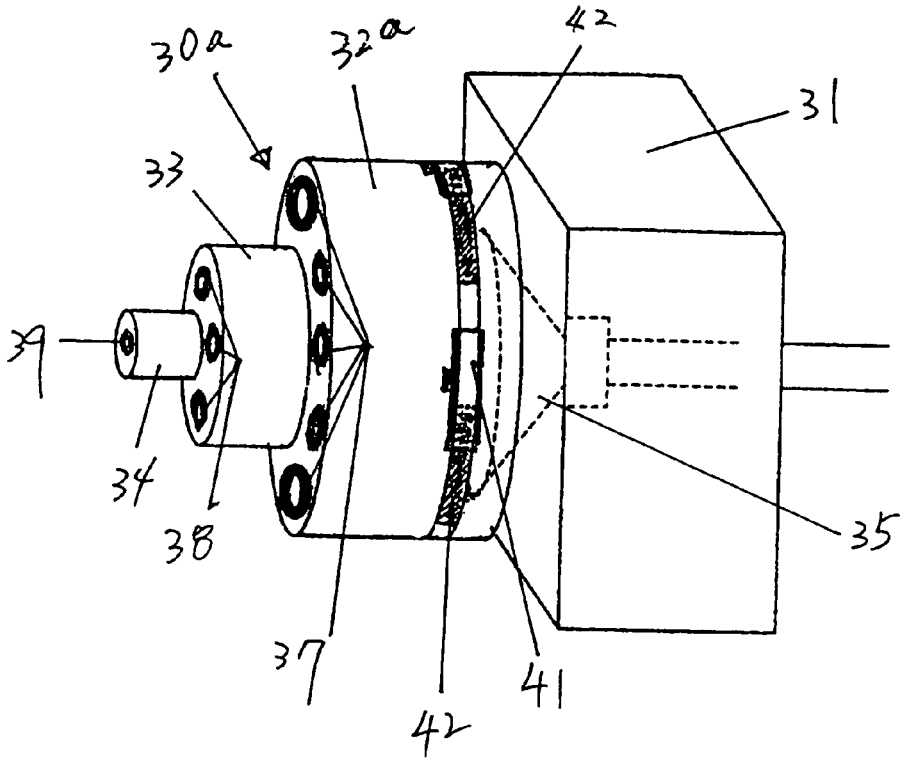
FIG. 8 is a schematic view in perspective of another alternate embodiment of the invention with adjustable pressure balance openings.

FIG. 8 illustrates an alternate embodiment of the invention with adjustable sound pressure apertures. More specifically, in the FIG. 8 embodiment fixed sound pressure apertures 36 are replaced with sound pressure apertures 41 shown as rectangular openings in the outer wall of low frequency housing portion 32*a*. A movable slide element 42 is associated with each aperture 41 so that the areal opening afforded by aperture 41 can be varied by moving slide 42. By adjusting each slide 42, the sound pressure apertures 41 can be fine tuned to any particular application environment. While apertures 41 and slides 42 are illustrated with rectangular geometry, other geometries (such as circular or elliptical) may be employed.

Figure 9:
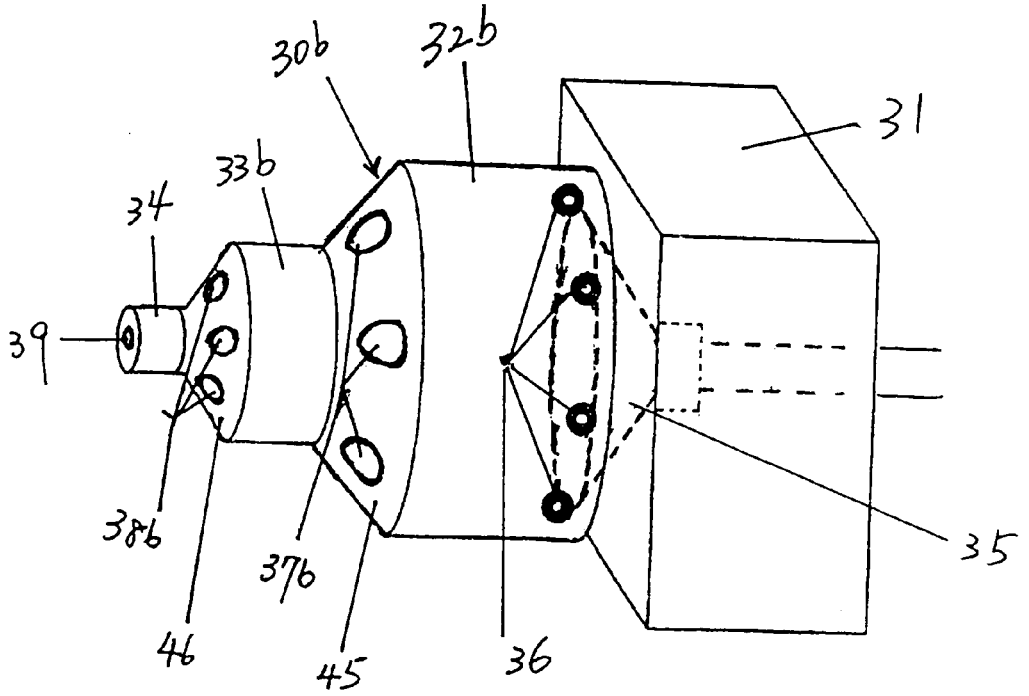
FIG. 9 is a schematic view in perspective of an alternate embodiment of the invention with sloping front wall surfaces.

FIG. 9 illustrates an alternate embodiment of the invention in which the outer surfaces of the low and mid-range frequency housing portions are sloped downwardly and outwardly. As seen in this Fig., low frequency housing portion 32*b* has a sloped or slanted outer wall 45; and mid-rang frequency housing portion 33*b* has a sloped or slanted outer wall 46. The apertures 37*b* and 38*b* have an oval shape in this embodiment, due to the tapered nature of the outer walls 45, 46.

Figure 10:
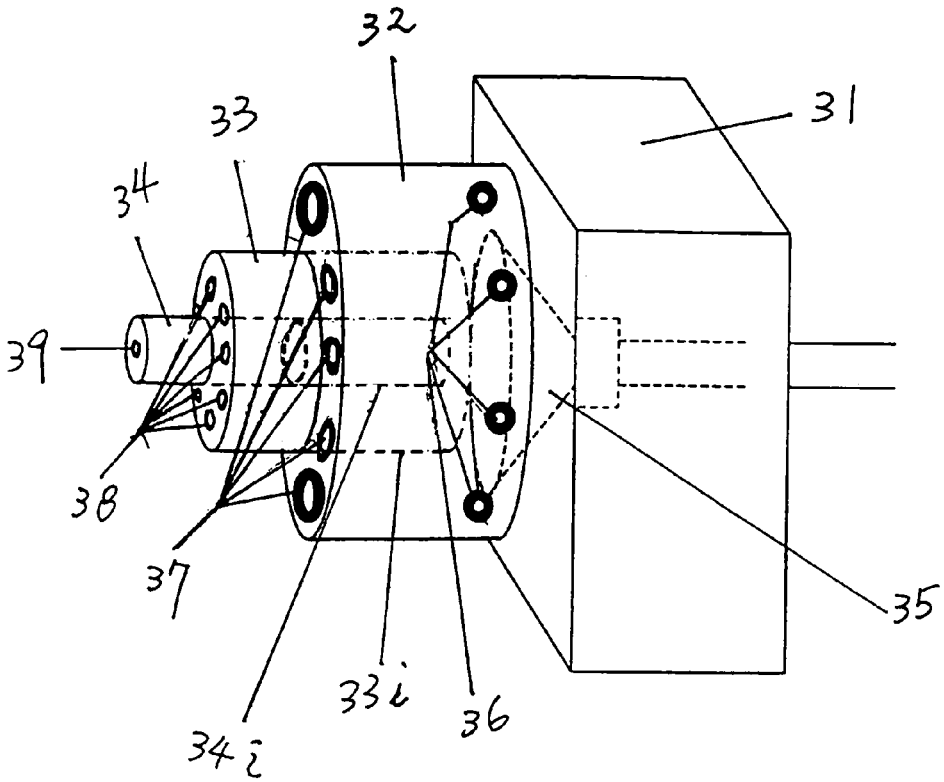
FIG. 10 is a schematic view in perspective of another alternate embodiment of the invention having mid-range and high frequency housing portions with external and internal segments.

FIG. 10 illustrates an alternate embodiment of the invention in which the mid-range and high frequency housing portions 33, 34 are modified to not only extend outwardly but also to intrude inwardly of the low frequency housing portion 32. As seen in this Fig., mid-range frequency housing portion 33 has an inner extension 33*i* which extends inwardly of the outer face of low frequency housing portion 32 toward the front plane of speaker/transducer 35. Similarly, high frequency housing portion 34 has an inner extension 34*i* which extends inwardly of the outer face of low frequency housing portion 32 toward the front plane of speaker/transducer 35. Inner extension 34*i* also extends inwardly of the front face of mid-range frequency housing portion 33.

Figure 11:
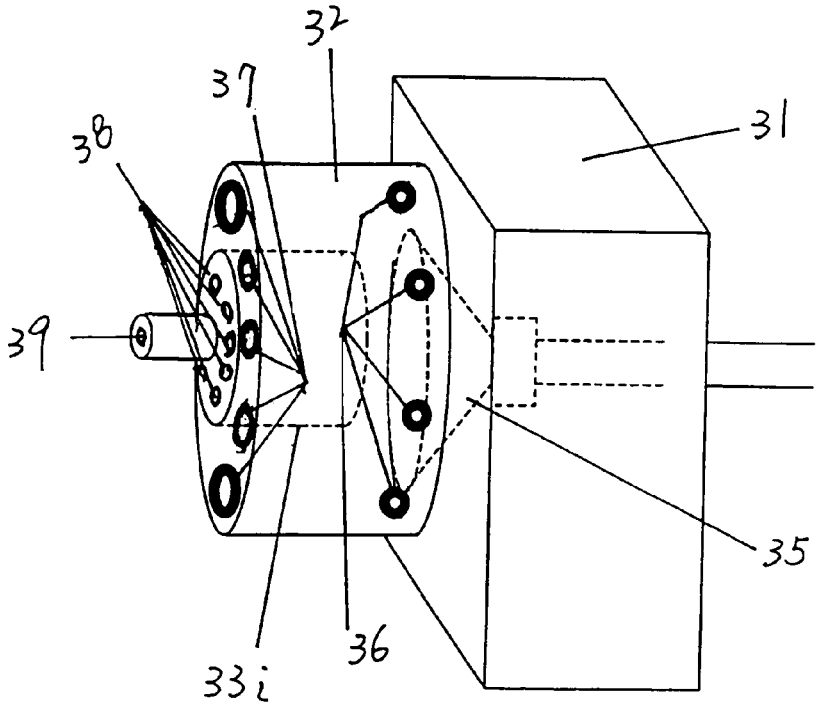
FIG. 11 is a schematic view in perspective of another alternate embodiment of the invention having a mid-range frequency housing portion which extends exclusively inwardly.

FIG. 11 illustrates an alternate embodiment of the invention in which the mid-range frequency housing portion 33 alone is modified to eliminate the outward protrusion and to provide an inward extension which intrudes inwardly of the low frequency housing portion 32. As seen in this Fig., mid-range frequency housing portion 33 has an inner extension 33*i* which extends inwardly of the outer face of low frequency housing portion 32 toward the front plane of speaker/transducer 35. High frequency housing portion 34 extends outwardly in this embodiment in a manner similar to that described above with reference to FIGS. 3 and 4.

Figure 12:
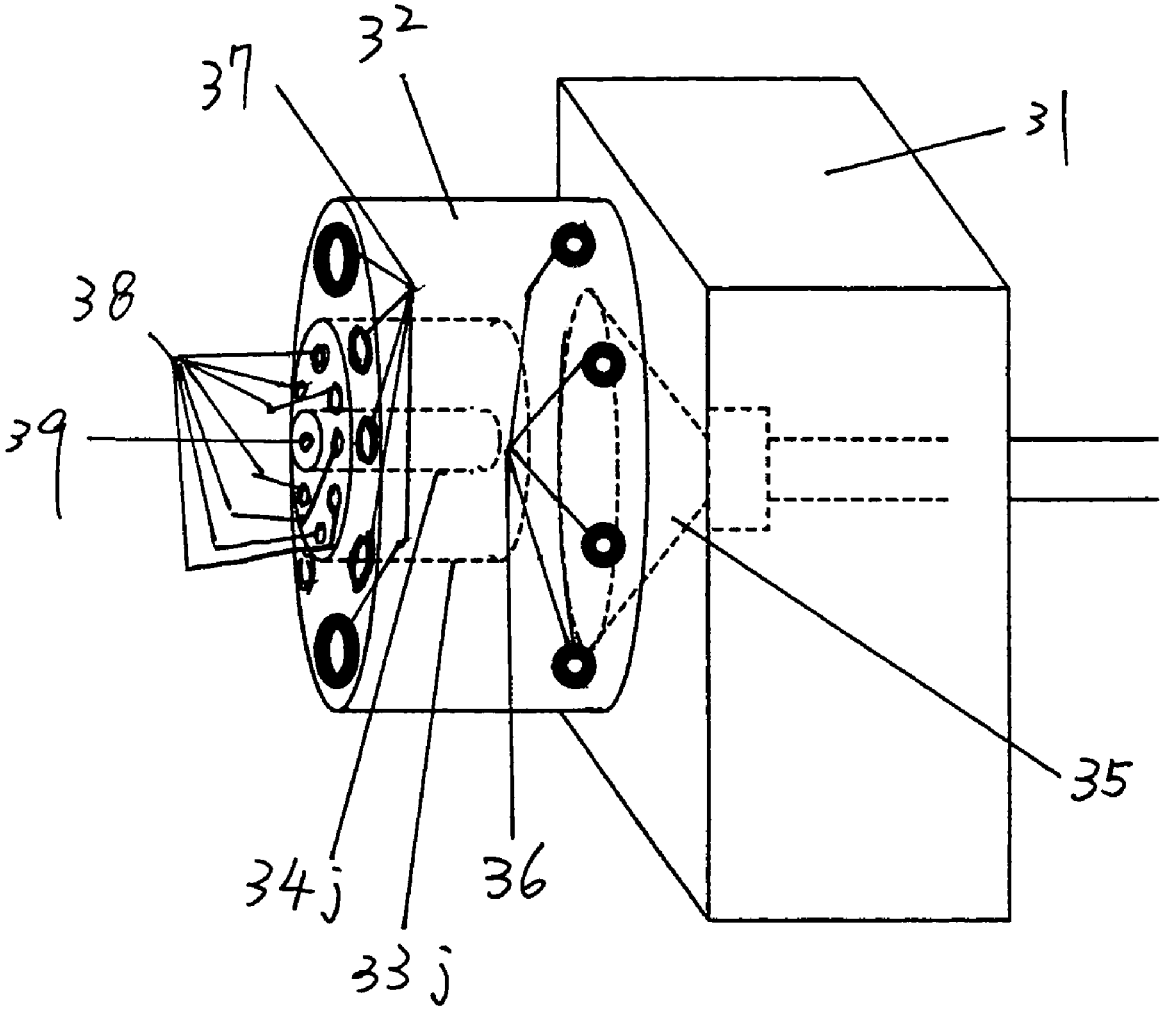
FIG. 12 is a schematic view in perspective of another alternate embodiment of the invention having mid-range and high frequency housing portions which extend exclusively inwardly.

FIG. 12 illustrates an alternate embodiment of the invention in which the outward extensions of both the mid-range and high frequency housing portions are eliminated and inwardly intruding extensions are provided. As seen in this Fig., the mid-range frequency housing portion is comprised of an inwardly extending member 33*j* which extends inwardly of the outer face of low frequency housing portion 32 toward the front plane of speaker/transducer 35. Similarly, the high frequency housing portion is comprised of an inwardly extending member 34*j* which extends inwardly of the outer face of low frequency housing portion 32 toward the front plane of speaker/transducer 35. This embodiment enjoys the advantage of requiring less axial space than the embodiment of FIGS. 3 and 4.

Figure 12B:
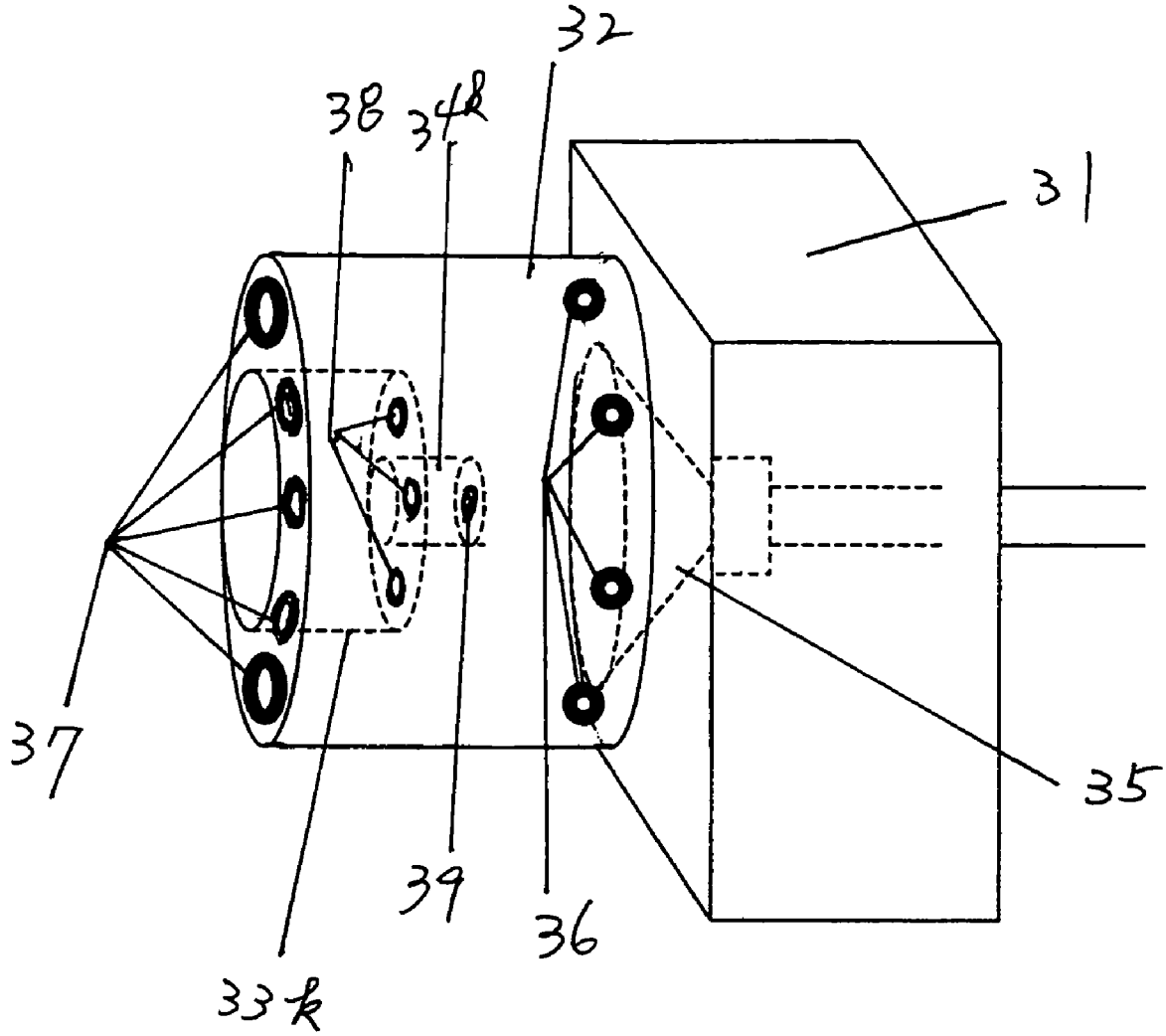
FIG. 12*b* is a schematic view in perspective of another alternate embodiment of the invention having mid-range and high frequency housing portions which extend exclusively inwardly

FIG. 12*b* illustrates an alternate embodiment of the invention in which the outward extensions of both the mid-range and high frequency housing portions are eliminated and inwardly intruding extensions are provided. The embodiment shown in this Fig. Is similar to that shown in FIG. 12, with the mid-range frequency housing portion having an inwardly extending member 33*k* which extends inwardly of the outer face of low frequency housing portion 32 toward the front plane of speaker/transducer 35. Similarly, the high frequency housing portion is comprised of an inwardly extending member 34*k* which extends inwardly of the outer face of low frequency housing portion 32 toward the front plane of speaker/transducer 35. In the FIG. 12*b* embodiment, member 34*k* extends inwardly a greater distance than member 33*k*. Further, mid-range frequency sound apertures 38 and high frequency aperture 39 are formed internally of low frequency housing portion 32; while the outer end surface of low frequency housing portion 32 has a central circular opening. Essentially, the arrangement of FIG. 12*b* represents a modification of the embodiment of FIGS. 3 and 4 in which the mid-range and high frequency housing portions are reversed along their common axis of revolution.

Figure 13:
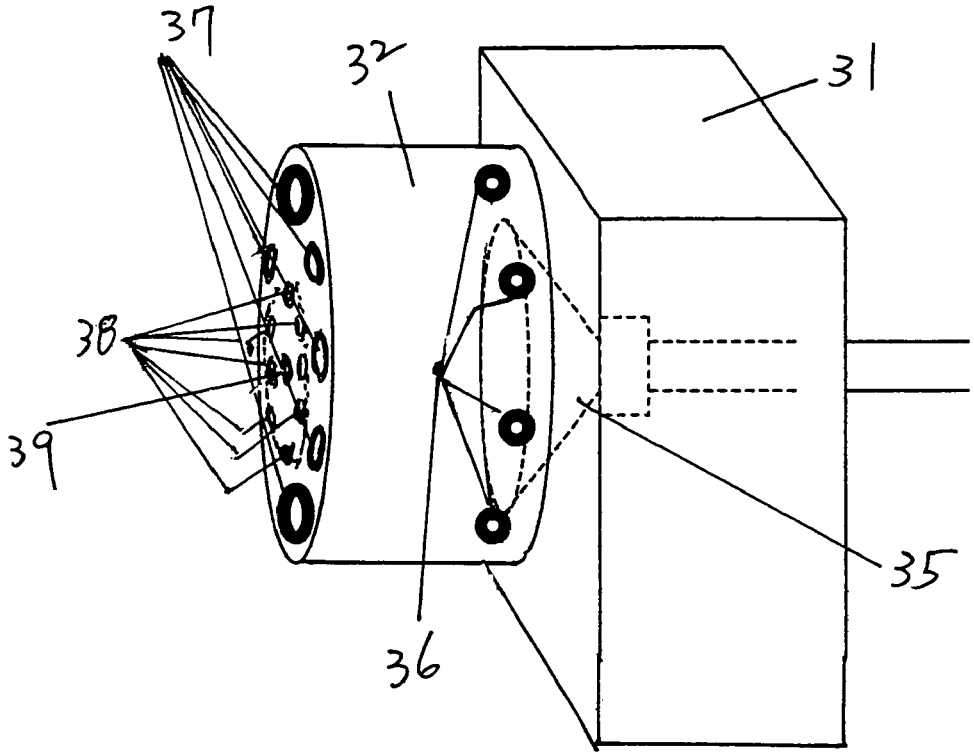
FIG. 13 is a schematic view in perspective of another alternate embodiment of the invention having only a single acoustic shaping housing portion.
Figure 14:
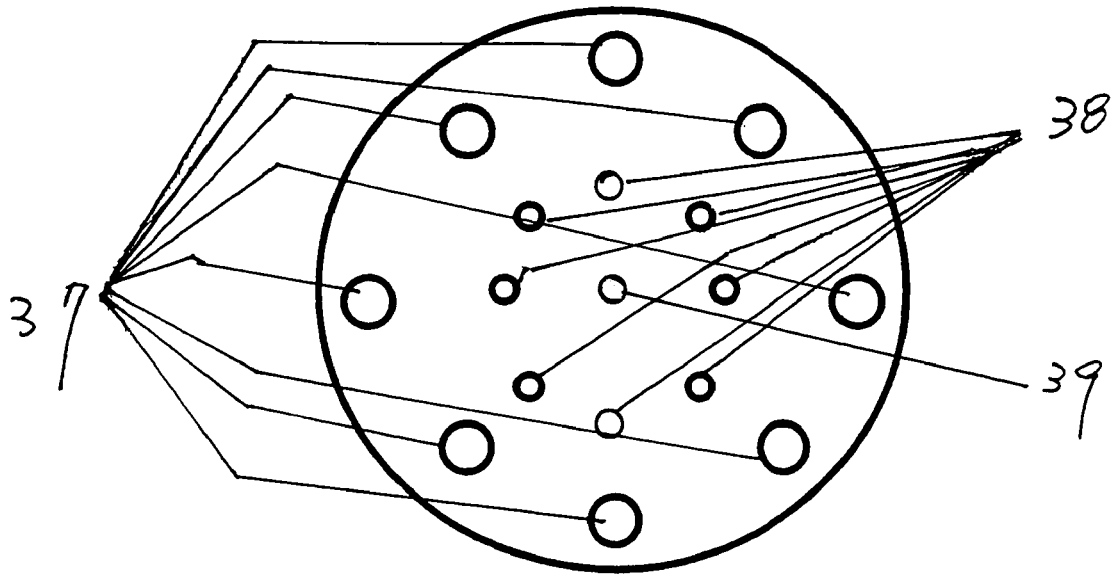
FIG. 14 is a front plan view of the embodiment of FIG. 13 showing the placement of the sound apertures.

FIGS. 13 and 14 illustrate an alternate embodiment of the invention requiring only a single simple enclosure. As seen in these Figs., the mid-range and high frequency enclosure portions are dispensed with, and the low frequency apertures 37, the mid-range apertures 38 and high frequency aperture 39 are all formed in the outer wall surface of low frequency housing portion 32.

Figure 15:
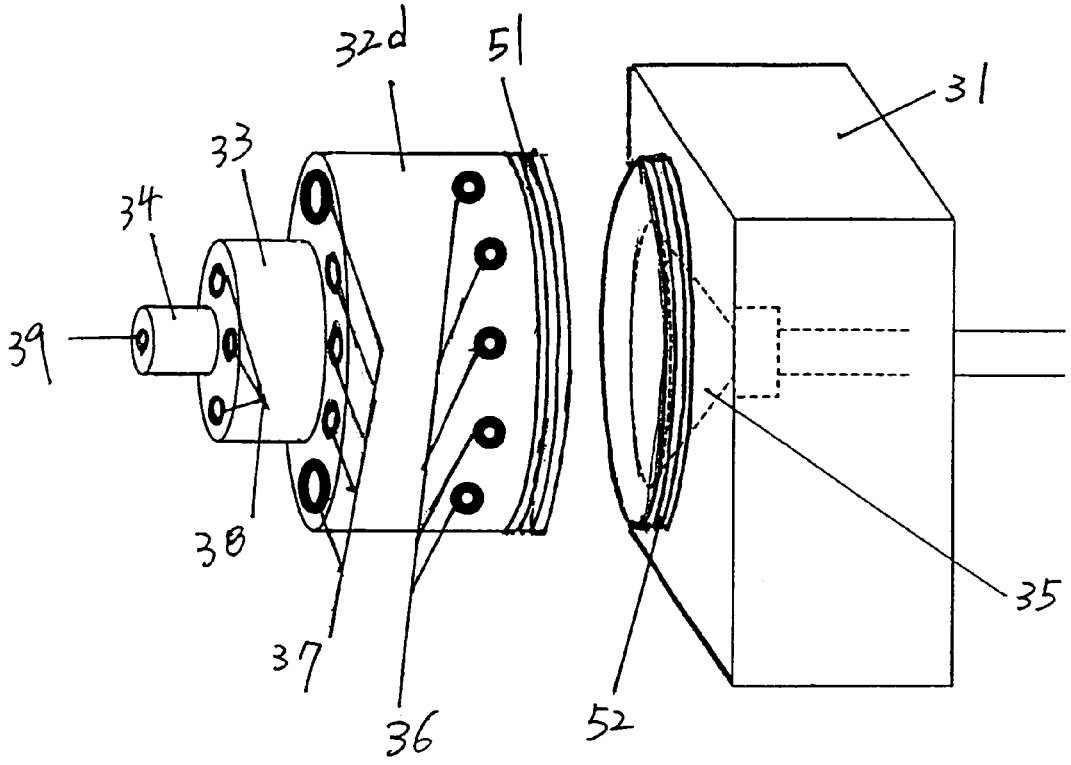
FIG. 15 is a schematic view in perspective of another alternate embodiment of the invention with detachable low, mid-range, and high frequency housing portions.

FIG. 15 illustrates an alternate embodiment of the invention in which the low, mid-range, and high frequency housing portions 32–34 are all detachable from the speaker housing portion 31. As seen in this Fig., a first detachable coupling element 51 is provided adjacent the inner edge of low frequency housing portion 32*d*. A complementary second detachable coupling element 52 is provided on the facing surface of housing portion 31. The elements 51, 52 can be implemented in many different ways: for example, coupling elements 51, 52 may comprise complementary male and female threaded members. In the alternative, coupling elements 51, 52 may comprise complementary snap-on members. Coupling arrangements found in the camera art which enable the attachment and detachment of a lens housing can be readily adapted for use in this embodiment of the invention. Other implementations will occur to those skilled in the art.

Figure 16:
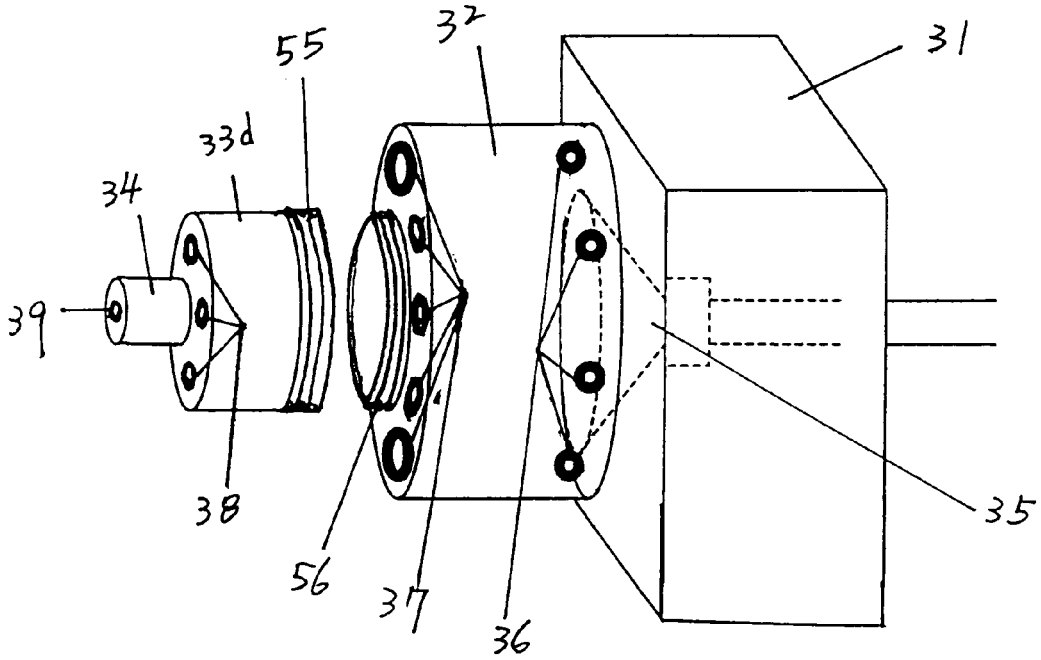
FIG. 16 is a schematic view in perspective of another alternate embodiment with detachable mid-range and high frequency housing portions.

FIG. 16 illustrates another alternate embodiment of the invention in which the mid-range and high frequency housing portions are detachable from the low frequency housing portion. As seen in this Fig., low frequency housing portion is firmly secured to housing portion 31. Mid-range frequency housing portion 33*d* is provided with a first detachable coupling element 55 adjacent the inner edge thereof. A complementary second detachable coupling element 56 is provided on the facing surface of low frequency housing portion 32. The elements 55, 56 can be implemented in many different ways: for example, coupling elements 51, 52 may comprise complementary male and female threaded members. In the alternative, coupling elements 51, 52 may comprise complementary snap-on members. Other implementations will occur to those skilled in the art.

Figure 17:
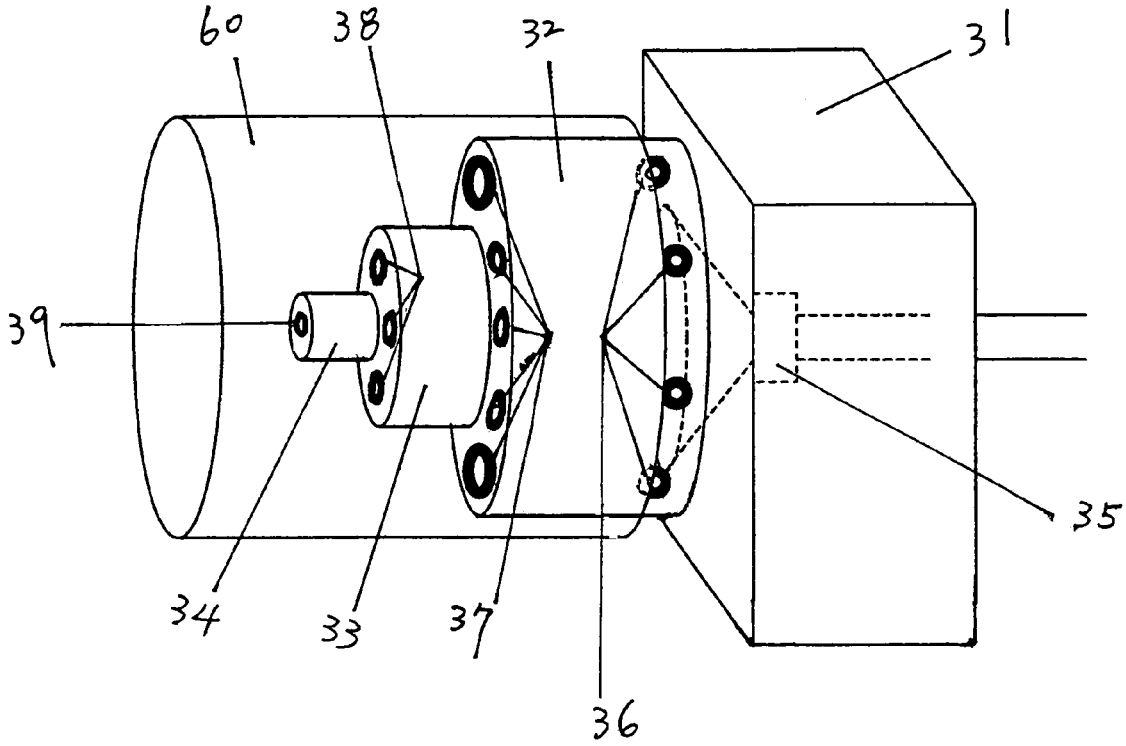
FIG. 17 is a schematic view in perspective of another alternate embodiment with a protective outer shield.

FIG. 17 illustrates an alternate embodiment of the invention in which a protective shield is provided for the low, mid-range, and high frequency housing portions. As seen in this Fig., a protective outer sleeve 60 having an axial length as least as great as the sum of the axial lengths of the low, mid-range, and high frequency housing portions 32, 33, and 34 surrounds these three members and provides a protective enclosure therefore. Sleeve 60 may comprise a separate element as shown, or may be formed as an integral part of portion 32, as desired. This embodiment is especially useful in a vehicle environment in which the speaker(s) are typically mounted in a kick panel or a passenger door. Sleeve 60 guards against accidental breakage or dislodging of the acoustic enclosures.

Figure 18:
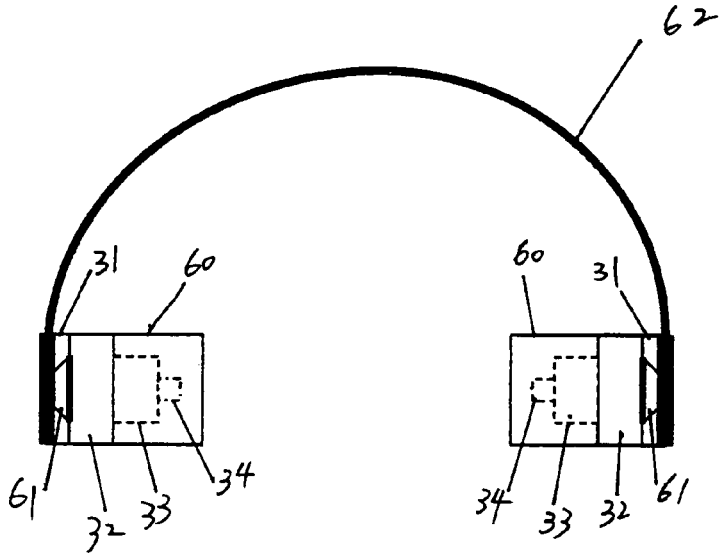
FIG. 18 is a schematic view of a headphone application of the invention.

While the invention has been described thus far for use in a home stereo or vehicle sound system, the invention has broad application in the field of sound. FIG. 18, for example, illustrates the application of the invention to personal headphones. As seen in this Fig., a headset has a head band 62 provided at each end with the invention. More specifically, a miniature transducer 61 generates sound which is shaped and enhanced by housing portions 32, 33, and 34. Protective sleeve 60 provides a more comfortable environment for the user.

As will now be apparent, the invention affords a simple, inexpensive acoustic enclosure which enables a single transducer to provide adequate sounds over the entire audio frequency spectrum. The enclosure can be preferably fabricated from inexpensive plastic materials which are durable and devoid of individual elements which promote mechanical vibrations. Instead of requiring separate audio transducers for the different portions of the audio frequency spectrum, a single transducer can be used to produce the desired sounds due to the frequency separation provided by the enclosure according to the invention.

While the several embodiments described herein have been limited to a single enclosure, in most applications of the invention two or more enclosures and a corresponding number of transducers will be arranged in the environment in order to provide the multiple channel effect. In a car stereo installation, for example, one enclosure may be mounted on each passenger door or front kick panel, and one or more enclosures may b mounted toward the rear of the vehicle. In a home theater installation, two laterally spaced enclosures may be placed along one wall of a room, and two enclosures may be arranged along an opposite wall. The number of enclosures and their relative placement is a matter of choice for the user.

Although the above provides a full and complete disclosure of the preferred embodiments of the invention, various modifications, alternate constructions and equivalents will occur to those skilled in the art. For example, the invention can be applied broadly to the field of acoustic systems, such as the design of hearing aids. Therefore, the above should not be construed as limiting the invention, which is defined by the appended claims.

What is claimed is:

1. An acoustic enclosure for a single audio transducer comprising:

a housing having a first end adapted to be acoustically coupled to an audio transducer, a second end, and a surface extending between said first and second ends; said first and second ends and said surface defining an acoustic enclosure having an interior; said surface having a plurality of sound pressure apertures formed therethrough in a region adjacent said first end; said second end having a plurality of sound apertures formed therethrough for allowing sounds produced by an associated sound transducer and traveling along said interior to emanate from said interior to ambient; said plurality of sound apertures including a first low frequency group for allowing low frequency sounds to emanate from said interior, a second mid-range frequency group for allowing mid-range frequency sounds to emanate from said interior, and a centrally positioned high frequency sound aperture for allowing high frequency sounds to emanate from said interior.

2. The invention of claim 1 wherein said surface is cylindrical, and said sound pressure apertures are distributed about the periphery of said cylindrical surface.

3. The invention of claim 1 wherein said second end is circular, said first low frequency group of sound apertures is distributed about said second end in a substantially circular pattern of first radius, and said second mid-range frequency group of sound apertures is distributed about said second end in a substantially circular pattern of second radius smaller than said first radius.

4. The invention of claim 1 wherein said first end includes a detachment coupling element for enabling said housing to be removable attached to an associated audio transducer housing.

5. The invention of claim 1 wherein said second end includes an outwardly extending portion terminating in an end wall portion; and wherein said high frequency sound aperture is formed in said end wall portion.

6. The invention of claim 5 further including a first interior sound enclosure portion extending inwardly from said second end of said housing into the interior thereof and defining a mid-range frequency enclosure area, said mid-range frequency sound apertures being located within said mid-range frequency enclosure area.

7. The invention of claim 1 wherein said second end includes a first outwardly extending portion terminating in a first end wall portion; and wherein said mid-range frequency sound apertures are formed in said first end wall portion.

8. The invention of claim 7 wherein said first outwardly extending portion is a discrete element having an inner end with a first detachable coupling element; and wherein said second end of said housing is provided with a complementary coupling element so that said discrete element can be detachably coupled to said second end of said housing.

9. The invention of claim 7 wherein said first end wall portion includes a second outwardly extending portion terminating in a second end wall portion; and wherein said high frequency sound aperture is formed in said second end wall portion.

10. The invention of claim 9 wherein said first and said second outwardly extending portions are cylindrical.

11. The invention of claim 10 wherein the diameter of said second outwardly extending portion is smaller than the diameter of said first outwardly extending portion.

12. The invention of claim 9 wherein said first end wall portion is tapered.

13. The invention of claim 12 wherein said second end wall portion is tapered.

14. The invention of claim 9 further including a protective shield member extending outwardly of said second end of said housing and surrounding said first and second outwardly extending portions.

15. The invention of claim 7 further including a first interior sound enclosure portion extending inwardly from said second nd of said housing into the interior thereof and defining a mid-range frequency enclosure area, said mid-range frequency sound apertures being located within said mid-range frequency enclosure area.

16. The invention of claim 9 further including a first interior sound enclosure portion extending inwardly from said second end of said housing into the interior thereof and defining a mid-range frequency enclosure area, said mid-range frequency sound apertures being located within said mid-range frequency enclosure area; and a second interior sound enclosure portion extending inwardly from said second end of said housing into the interior thereof and defining a high frequency enclosure area, said high frequency sound aperture being located within said high frequency enclosure area.

17. The invention of claim 1 further including a first interior sound enclosure portion extending inwardly from said second end of said housing into the interior thereof and defining a mid-range frequency enclosure area, said mid-range frequency sound apertures being located within said mid-range frequency enclosure area.

18. The invention of claim 17 further including a second interior sound enclosure portion extending inwardly from said second end of said housing into the interior thereof and defining a high frequency enclosure area, said high frequency sound aperture being located within said high frequency enclosure area.

19. The invention of claim 18 wherein said high frequency enclosure area is smaller than said mid-range frequency enclosure area.

20. The invention of claim 1 wherein at least some of said sound pressure apertures are provided with an adjustment element for enabling the size thereof to be varied.

* * * * *